US005975823A

United States Patent [19]

Schlough

[11] Patent Number: 5,975,823

[45] Date of Patent: Nov. 2, 1999

[54] METHOD OF FORMING SHEET MATERIAL ASSEMBLAGE

[75] Inventor: James R. Schlough, Troy, Ohio

[73] Assignee: Heidelberger, Druckmaschinen AG, Heidelberg, Germany

[21] Appl. No.: 08/927,954

[22] Filed: Sep. 11, 1997

[51] Int. Cl.[6] ..... B65H 5/30

[52] U.S. Cl. ..... 412/8; 412/9; 412/19; 270/58.07; 270/58.08

[58] Field of Search ..... 412/4, 5, 8, 19, 412/9, 11; 270/52.14, 52.18, 58.01, 58.08, 52.23, 58.07

[56] References Cited

U.S. PATENT DOCUMENTS

| | | | |
|---|---|---|---|
| 2,895,730 | 7/1959 | Biel et al. | 270/37 |
| 4,170,346 | 10/1979 | Murray et al. . | |
| 4,420,148 | 12/1983 | Meadows | 270/41 |
| 4,477,067 | 10/1984 | Wise . | |
| 4,486,011 | 12/1984 | Rhunke | 270/52.23 |
| 4,641,825 | 2/1987 | Mowry et al. . | |
| 4,988,086 | 1/1991 | Schlough . | |
| 5,067,699 | 11/1991 | Gadway et al. . | |
| 5,232,324 | 8/1993 | Graushar . | |
| 5,261,769 | 11/1993 | Leclerc . | |
| 5,615,871 | 4/1997 | Kleinhen . | |
| 5,622,268 | 4/1997 | Conner et al. . | |
| 5,738,346 | 4/1998 | Ishida | 270/58.07 |

FOREIGN PATENT DOCUMENTS

| | | |
|---|---|---|
| 4334225 | 4/1995 | Germany . |

*Primary Examiner*—Andrea L. Pitts
*Assistant Examiner*—Henry W. H. Tsai
*Attorney, Agent, or Firm*—Tarolli, Sundheim, Covell, Tummino & Szabo

[57] ABSTRACT

A polarized lens is mounted to a helmet having a transparent face shield to cover a top portion of the face shield and reduce glare in the user's field of vision. In the preferred embodiment of the invention, the polarized lens does not cover the lower portion of the transparent face shield so that the user's primary field of vision can be adjusted to pass through the uncovered lower portion of the transparent face shield when the user tilts their head back slightly. The lens is preferably attached to the helmet using hook and loop fastener. On a sunny day, a helmet wearer, e.g. a snowmobiler or a motorcycle rider, can attach the polarized lens to reduce glare, and can tilt their head back slightly if the sunlight disappears temporarily (e.g. when the vehicle passes into the woods). In addition, the user can easily remove the polarized lens if the sunlight disappears for an extended time.

14 Claims, 3 Drawing Sheets

METHOD OF FORMING SHEET MATERIAL ASSEMBLAGE

FIELD OF THE INVENTION

The invention relates to a polarized lens which covers the transparent face shield on helmets typically worn by snowmobilers or motorcycle riders.

BACKGROUND OF THE INVENTION

Helmets worn by snowmobilers typically include a transparent face shield. This is also often true for motorcycle helmets. The transparent face shield is normally hinge-mounted to the helmet so that the face shield can rotate between a position in front of the user's face to a position above the user's face. Under normal operating conditions, the helmet wearer places the face shield in a closed position to protect the face from wind and/or debris. Usually, the hinge includes a ratchet mechanism to lock the face shield at various degrees of rotation and prevent rotation of the face shield unless the user uses their hand to move the face shield.

Face shields in snowmobile and motorcycle helmets are either clear or tinted. Many snowmobilers and motorcycle riders prefer clear face shields because a tinted face shield is not desirable when it is dark or otherwise not sunny outside. A common occurrence, especially among snowmobilers, is to alternate the use of clear and tinted face shields depending on the weather conditions. The replacement of face shields, however, requires tools and is cumbersome. Also, it is often difficult to store an additional face shield on the vehicle. For these reasons, many snowmobilers or motorcycle riders use helmets having clear, non-tinted face shields, and wear sunglasses underneath the helmet when it is sunny outside. Sunglasses worn underneath a snowmobile helmet tend to fog. Also, the added pressure against the head from the helmet pushing on the ear piece of the sunglasses can cause headaches in some of people.

In addition, it is difficult for a driver to see through a tinted face shield when the vehicle passes from a sunlit area temporarily into a shaded area. This is a common occurrence when snowmobiling because in as much as many snowmobile trails frequently pass into and out of wooded areas. Likewise, when a snowmobiler wearing sunglasses under the helmet drives into a shaded area, such as into the woods, it is difficult to see through the sunglasses due to the relative darkness.

SUMMARY OF THE INVENTION

In one aspect, the invention is a polarized lens shaped to cover a top portion of a transparent face shield of a helmet. The polarized lens does not cover the lower portion of the transparent face shield. The polarized lens thus reduces glare in the user's field of vision when the user is holding their head comfortably in a normal upright position. However, the invention allow users to easily account for temporary shade, for instance when a snowmobiler enters a shaded area such as the woods or the like, by cocking their head slightly backward so that the user's primary field of vision passes under the polarized lens through the uncovered lower portion of the transparent face shield. Preferably, the bottom edge of the polarized lens is located 1⅛ inches above the bottom edge of the transparent face shield, thus providing a 1⅛ inch span underneath the polarized lens 10 to accommodate the user's field of vision when the user encounters shade.

It is important that the polarization axis of the polarized lens be generally horizontal when the polarized lens is mounted to the helmet, as is conventional with polarized sunglasses. This is because reflected light, such as light reflected from snow-covered ground, is normally polarized in such a manner that a horizontal polarization axis optimizes glare reduction. It is preferred that the lens span entirely across the transparent face shield from its right side to its left side in order to account for peripheral glare.

In the preferred embodiment of the invention, the polarized lens is removably mounted to the helmet adjacent an outside surface of the transparent face shield. It is preferred to use strips of hook and loop fastener along the top and side edges of the lens and the transparent face shield. Preferably, the hook component of the hook and loop fastener is applied to the face shield on the helmet. This is preferred because the fastener strips remain on the helmet even when the polarized lens is removed, and the hook component is more durable than the loop component under these conditions.

In this embodiment of the invention in which the polarized lens is removable from the helmet, the invention can be easily applied to existing helmets. Thus, it is desirable to provide a kit for distribution which includes the polarized lens with the respective strips of hook and loop fastener pre-attached to the lens (i.e. the loop component of the hook and loop fastener strips attached to the lens), loose mating strips of hook and loop fastener intended to be applied to the helmet (i.e. the hook component of the hook and loop fastener strips), with the backing remaining on the adhesive side of the mating strips. The polarized lens in the kit should be custom-shaped for the particular helmet model for which it is intended. Preferably, the loose mating strips of hook and loop fastener are pre-cut in proper lengths for the particular model of helmet. It may also be desirable to provide a bag for the polarized lens with the kit, for protecting the lens when it is not in use. Such a bag preferably has an absorbent, scratch-resistant interior surface. Also, the bag preferably has an absorbent, scratch-resistant exterior surface to facilitate cleaning of the lens.

In another embodiment of the invention, the polarized lens is permanently attached to the transparent face shield, preferably directly to the inside surface of the transparent face shield. This should be accomplished using optical quality adhesive to adhere the entire surface of the lens to the face shield to avoid fogging, moisture accumulation and the like between the lens and the transparent face shield.

In another aspect of the invention, the polarized lens completely covers the transparent face shield, yet is removable. The removable, full-face polarized lens is mounted to the helmet adjacent an outside surface of the transparent face shield, preferably using strips of hook and loop fastener around the edges of the transparent face shield and the polarized lens. While such a system does not provide the gradient effect of the polarized lens over the transparent face shield, the removability of the full-face, polarized lens is a significant improvement over wearing sunglasses underneath the helmet and/or changing mechanically between clear and tinted face shields.

Other features and advantages of the invention should become apparent to those skilled in the art upon inspecting the following drawings and description thereof.

BRIEF DESCRIPTION OF THE DRAWINGS

FIG. 4A is a view similar to FIG. 4 showing an alternate embodiment of mounting the removable polariod lens.

FIG. 8 is a perspective view of a snowmobile helmet having a transparent face shield with a polarized lens mounted to the helmet to cover the entire transparent face shield in accordance with another aspect of the invention.

FIG. 9 is a view similar to FIG. 8 showing the full-face polarized lens removed from the transparent face shield of the helmet.

DETAILED DESCRIPTION OF THE DRAWINGS

FIGS. 1–5 refer to a first embodiment of the invention in which a polarized lens 10 is removably mounted to a helmet 12 to partially cover a transparent face shield 14 for the helmet 12. FIG. 6 refers to an embodiment of the invention in which the polarized lens 10 is adhered permanently to an inside surface of the transparent face shield 14 to partially cover the transparent face shield.

Figure 1:
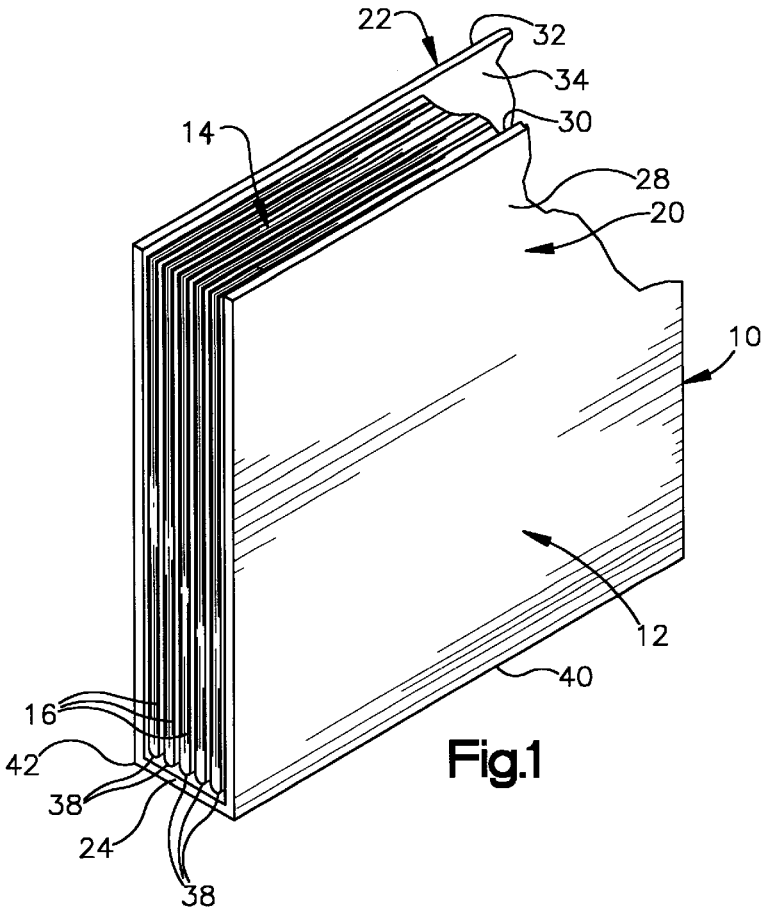
FIG. 1 is a perspective view of a snowmobile helmet having a transparent face shield with a polarized lens mounted to the helmet to cover a portion of the transparent face shield in accordance with one aspect of the invention.
Figure 2:
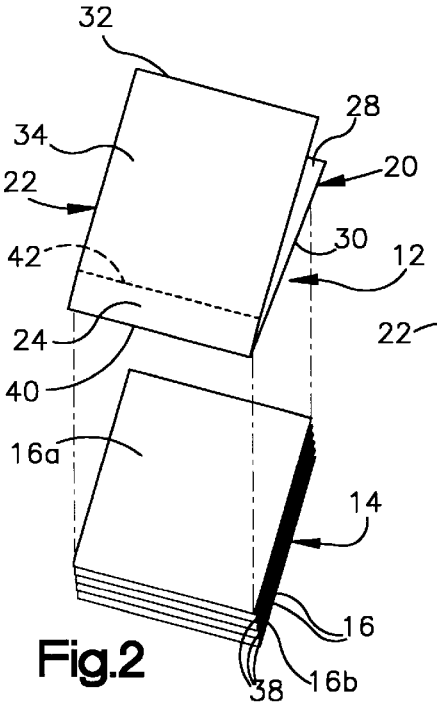
FIG. 2 is a view similar to FIG. 1 showing the polarized lens removed from the transparent face shield of the helmet.

Referring in particular to FIGS. 1 and 2, the polarized lens 10 is removably attached to the helmet 12 to cover a top portion 16 of the transparent face shield 14. The polarized lens 10 reduces glare in the user's field of vision when the user is holding their head comfortably in a normal upright position. In FIGS. 1 and 2, the polarized lens 10 does not cover a lower portion 18 of the transparent face shield 14. This allows the user's primary field of vision to pass through the uncovered lower portion 18 of the transparent face shield 14 when the user tilts their head slightly back.

The polarized lens 10 is preferably manufactured from a sheet of laminated linear polarizer, such as is commercially available from International Polarizer, Inc., Marlborough, Mass. The preferred laminated linear polarizer comprises a polymeric polarizer laminated with cellulose acetobutyrate. For the embodiment of the invention shown in FIGS. 1–5 where the polarized lens 10 is removably attached outside of the helmet 12, it is desirable to use a laminated linear polarizer having a thickness of about 0.03 inches to provide sufficient strength and durability to withstand wind, etc. The shape of the polarized lens 10 is preferably formed using a steel form die-cut. In most instances, it will be desirable to customize the shape of the polarized lens 10 for the particular shape of the transparent face shield 14 of the particular helmet for which it is designed. The sheets of laminated linear polarizer normally include a protective covering over both the inside surface and the outside surface, and it is preferred to leave the removable protective coating on the sheets during fabrication. As is conventional with polarized sunglasses, the polarization axis of the polarized lens 10 is preferably horizontal when the lens 10 is attached to the helmet 12. Glare consists of polarized light reflected from the surface, e.g. from snow-covered surfaces for snowmobile riders, and the polarized lens 10 absorbs most if not all of the glare yet allows desired light to pass through.

The polarized lens 10 is preferably mounted directly to the transparent face shield 14 of the helmet 12 using strips 20A, 20B, 20C and 22A, 22B and 22C of hook and loop fastener, commonly known as Velcro. The loop component 22A, 22B and 22C of the hook and loop fastener strips is applied to an inside surface 24 of the removable lens 10, see FIG. 3. The strips 22A, 22B, 22C are preferably ¼ inch wide. Strip 22A is applied to the inside surface 24 of the lens 10 along a top edge 26 of the lens 10. Strip 22B is applied to the inside surface 24 of the lens 10 along a left side edge 28 of the lens 10. Strip 22C is applied to the inside surface 24 of the lens 10 along a right side edge 30 of the lens 10. In general, the strips 22A, 22B and 22C are applied to the inside surface 24 of the lens 10 and are located out of the normal field of vision of a user wearing the helmet 12. Mating strips 20A, 20B, 20C of the hook component of hook and loop fasteners are applied preferably directly on the transparent face shield 14 of the helmet 12, also out o the normal field of vision of a user wearing the helmet 12. Strip 20A is applied to an outside surface of the transparent face shield 14 along a top edge 32 of the face shield 14. Strip 20B is applied to an outside surface of the face shield 14 adjacent a part of a left edge (not specifically shown) of the face shield 14. Strip 20C is applied to an outside surface of the face shield 14 adjacent a top part of the right edge 20C of the transparent face shield 14. The polarized lens 10 is removably attached to the helmet 12 by engaging strips 22A, 22B, 22C on the lens 10 with the strips 20A, 20B and 20C on the helmet 12. FIG. 4 shows a cross-section of the removable polarized lens 10 being attached to the transparent face shield 14 of the helmet 12 in this manner. Note that FIG. 4 shows a helmet 12 having a transparent face shield 14 that is permanently closed, whereas the helmet 12 shown in FIGS. 1 and 2 has the transparent face shield 14 attached to a movable frame 14A which can be rotated about pivot 14B to open and close the face shield 14.

As can be seen in FIG. 4, a small space will typically exist between the lens 10 and the covered portion 16 of the transparent face shield 14. Since the lens 10 is on the outside of the transparent face shield 14, it is unlikely that fogging will occur in the space. However, depending on the specific mounting configuration of the lens 10 to the helmet 12, it may be possible for snow dust to accumulate in the space between the lens 10 and the face shield 14. Snow dust accumulation can be prevented from collecting within this space by providing a transparent seal (e.g. a snow dust guard) on the bottom edge 34 of the lens 10 which extends inward against the face shield 14. Alternatively, it may be possible to tilt the mounting of the lens 10 on the helmet 12 so that the bottom edge 34 of the removable lens 10 rests close or near the transparent face shield 14 FIG. 4A.

Referring again to FIGS. 1 and 2, the removable polarized lens 10 covers the transparent face shield 14 from the top edge 32 of the face shield 14 downward to a bottom edge 34 of the lens 10. For most helmets, the bottom edge 34 of the lens 10 should be located between 1⅝ inch to ⅝ inches above the corresponding location on the bottom edge 36 of the transparent face shield 14 when the polarized lens 10 is mounted to the helmet 12. Preferably, the bottom edge 34 of the lens 10 is located 1⅛ inch above the bottom edge 36 of the transparent face shield 14. Testing has determined that this configuration allows optimized glare reduction for most helmet designs, yet allows the helmet user to comfortably redirect their field of vision through the uncovered lower portion 18 of the face shield 14. It is also preferred that the polarized lens 10 span continuously across the face shield 14 between the left side edge and the right side edge 20C of the transparent face shield 14 to account for peripheral glare. In general, it is preferred in this embodiment of the invention that the polarized lens 10 cover approximately ⅔ of the surface area of the transparent face shield 14.

A printable grip strip 38 is preferably adhered to the outside surface of the removable lens 10 entirely along the top edge 26 of the lens 10. The grip strip 38 is preferably made from an ultraviolet protected vinyl adhesive tape. The grip strip 38 provides a location for a user to grab the lens 10 without harming the lens surface. The grip strip 38 also covers the strip 22A of hook and loop fastener on the inside surface of the lens 10 as well as most of strips 22B and 22C, from view in front of the lens 10. A company logo or the like can be printed on the grip strip 38.

Figure 3:
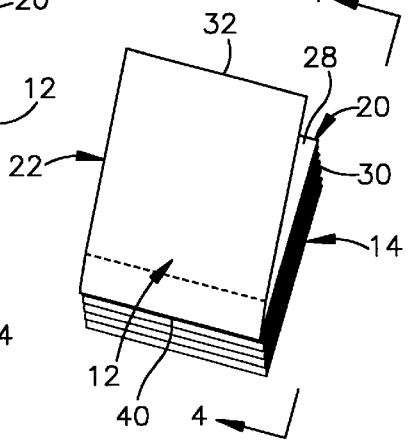
FIG. 3 is a rear elevational view of a removable polarized lens in accordance with the invention.
Figure 4:
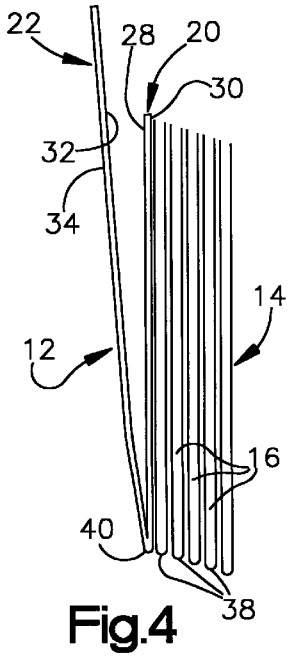
FIG. 4 is a sectional view taken along line 4–4 in FIG. 1.

In order to facilitate attachment and removal of the polarized lens 10 from the transparent face shield 14, which may be cumbersome for people wearing gloves, the lens 10 is preferably designed so that portions 40B, 40C, FIG. 3, extend outward beyond the strips 22B and 22C of hook and loop fastener. The portions 40B and 40C thus serve as handle means to facilitate the attachment and removal of the lens 10.

Figure 7:
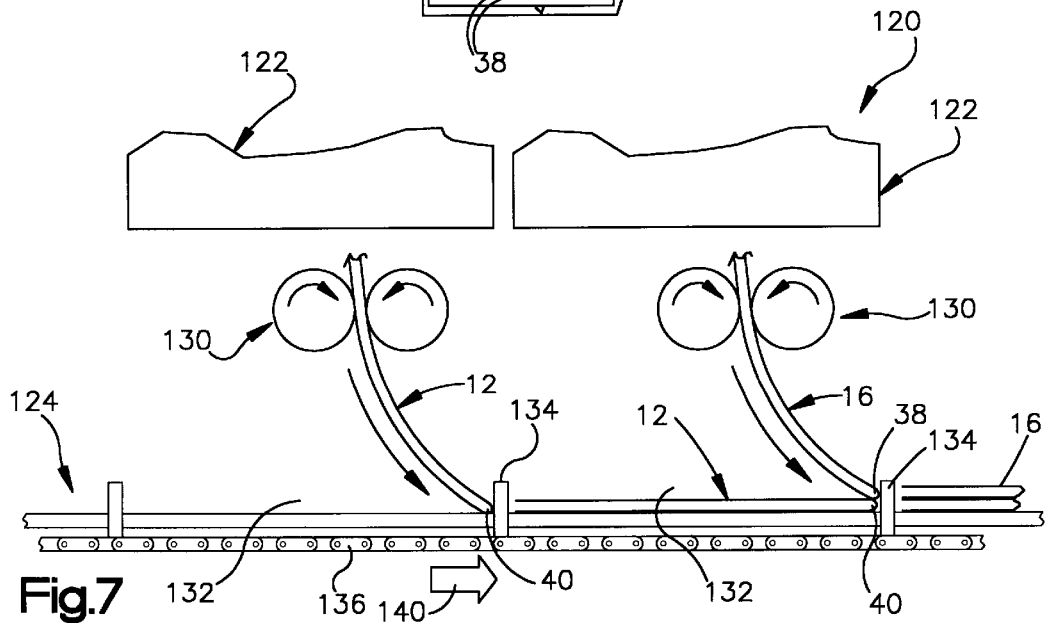
Fig.7 PRIOR ART
FIG. 7 is a schematic view showing the components of a kit that facilitates distribution of the invention to existing snowmobile helmets, and also store the polarized tinted lens when not in use.

FIG. 7 illustrates the components of a kit 42 that is provided to a helmet owner who desires to implement the invention on a pre-existing helmet. The kit includes a polarized lens 10 as previously described with respect to FIGS. 1–5, precut strips 20A, 20B and 20C of mating hook and loop fastener, and a bag 44 for storing the lens 10 when it is not in use. It is preferred that the strips of hook and loop fastener 22A, 22B, 22C on the lens 10 be pre-attached to the inside surface of the lens 10 when distributing the kit 42. The strips of hook and loop fastener 20A, 20B, 20C should have the adhesive-backed surface covered by a backing strip, and should be sized in correspondence to the strips 22A, 22B, 22C pre-applied to the lens 10. The bag 44 is preferably made of a soft cloth material. The inside surface of the bag should be absorbent and scratch-resistant to protect the lens 10. The outside surface of the bag 44 should be absorbent and scratch-resistant as well to facilitate convenient cleaning of the lens 10 inasmuch as it may be difficult to locate suitable fabric for cleaning the lens while snowmobiling. The bag 44 includes a drawstring 46 to close the bag 44 with the lens 10 therein.

The invention has been described thus far as showing the polarized lens 10 removably attached to the outside surface of the transparent face shield 14 using hook and loop fasteners, however, the inventor has contemplated other means of attaching the lens 10 to the helmet 12. For example, snaps or the like could possibly be used to removably attach the polarized lens 10. In addition, it may be desirable in certain circumstances to permanently attached the polarized lens 10 to the transparent face shield 14.

FIG. 6 illustrates the preferred manner of permanently attaching the polarized lens 10 to the transparent face shield. In FIG. 6, a die-cut sheet 10A of a laminated linear polarizer is permanently adhered directly to an inside surface 48 of the transparent face shield 14. It is desirable that the formed sheet 10A in FIG. 6 have generally the same shape and characteristics of the formed sheet of laminated linear polarizer for the removable lens 10 shown in FIGS. 1–5. It is desirable, however, that the thickness of sheet 10A be thinner, e.g. 0.01 inch thickness, mostly so that the polarized lens 10A does not interfere with any of the mechanical mechanisms of the helmet 12. Optical quality adhesive should be used to adhere the entire surface of the polarized lens 10A to the inside surface of the transparent face shield 14 in order to eliminate the possibility of fogging or moisture accumulation between the polarized lens 10A and the inside surface of the transparent face shield 14. In other respects, the embodiment of the invention shown in FIG. 6 is similar to the embodiment of the invention shown in FIGS. 1–5.

Many helmet manufacturers use a double lens technology for the transparent face shield 14. In these systems, it may be desirable for an original equipment manufacturer to place the polarized lens 10 between the double lenses of the transparent face shield.

FIGS. 8 and 9 refer to another embodiment of the invention in which a full-face, polarized lens 110 covers the entire transparent face shield 14. The full-face polarized lens 110 shown in FIGS. 8 and 9 is removable, and is mounted to the helmet 12 using hook and loop fasteners. Preferably, hook and loop fastener is applied to an inside surface of the full-face polarized lens entirely along the peripheral edge of the lens 110. One or more mating strips 120A, 120C, and 120D of hook and loop fastener are adhered directly to the transparent face shield 14 also along the peripheral edge of the transparent face shield. In other respects, the full-face polarized lens 110 shown in FIG. 8 is similar to the polarized lens 10 shown in FIGS. 1–5. While the embodiment of the invention shown in FIGS. 8 and 9 does not allow the user of the lens 110 to quickly account for temporary relative darkness by cocking their head back slightly, the full-face polarized lens 110 shown in FIG. 8 may provide improved glare reduction for some users in some applications. The removable full-face polarized lens 110 shown in FIG. 8 is obviously more convenient to use than mechanically alternating between a tinted face shield and a clear face shield.

The invention has been described thus far primarily in connection with use on a snowmobile or motorcycle helmet, however, it should be recognized to those skilled in the art that the invention can be used on helmets used in other applications as long as the helmet has a transparent face shield. In addition, while the invention has been described in conjunction with exemplary embodiments, alternatives, modifications and equivalents to the invention may be apparent to those skilled in the art. The following claims should be interpreted to cover such alternatives, modifications and equivalents.

I claim:

1. An apparatus for a helmet having a transparent face shield, wherein the transparent face shield is capable of being located in front of a user's face when the user is wearing the helmet so that the user's field of vision passes through the transparent face shield and wherein the face shield also blocks wind and debris from the user's face, the apparatus comprising:

a polarized lens mounted to partially cover the transparent face shield, wherein a top portion of the transparent face shield is covered by the polarized lens to reduce glare in the user's field of vision when the user is holding their head comfortably in a normal upright position, and a lower portion of the transparent face shield is not covered by the polarized lens so that the user's primary field of vision is able to pass through the uncovered lower portion of the transparent face shield when the user's head is tilted back slightly; wherein the polarized lens is removably mounted to the helmet adjacent an outside surface of the transparent face shield; and a grip strip is provided along an outer surface of the polarized lens along a top edge of the polarized lens.

2. Apparatus for a helmet having a transparent face shield as recited in claim 1 wherein the grip strip is made of an ultraviolet protected vinyl adhesive tape and is adhered along an outer surface of the polarized lens along a top edge of the polarized lens.

3. The apparatus for a helmet having a transparent face shield as recited in claim 1 wherein the polarized lens is manufactured by forming the lens from a sheet of a laminated linear polarizer in which the polarization axis of the laminated linear polarizer is generally horizontal when the lens is attached to the helmet.

4. An apparatus for a helmet having a transparent face shield, wherein the transparent face shield is capable of being located in front of a user's face when the user is wearing the helmet so that the user's field of vision passes through the transparent face shield and wherein the face shield also blocks wind and debris from the user's face, the apparatus comprising:

a polarized lens mounted to partially cover the transparent face shield, wherein a top portion of the transparent face shield is covered by the polarized lens to reduce glare in the user's field of vision when the user is holding their head comfortably in a normal upright position, and a lower portion of the transparent face shield is not covered by the polarized lens so that the user's primary field of vision is able to pass through the uncovered lower portion of the transparent face shield when the user's head is tilted back slightly, the polarized lens is removably mounted directly to the transparent face shield of the helmet by using:

a first piece of strip fastener applied along at least a portion of a top edge of the polarized lens and a mating piece of fastener applied along a top edge of the transparent face shield;

a second piece of strip fastener applied along at least a portion of a right side edge of the polarized lens and a mating piece of strip fastener applied along a right side edge of the transparent face shield; and a third piece of strip fastener applied along at least a portion of a left side edge of the polarized lens and a mating piece of strip fastener applied along a left side edge of the transparent face shield; and the polarized lens extends outward beyond the strip fastener on either the left or the right side of the polarized lens to provide handle means for facilitating the attachment or removal of the removable polarized lens from the transparent face shield.

5. An apparatus a helmet having a transparent face shield, wherein the transparent face shield is capable of being located in front of a user's face when the user is wearing the helmet so that the user's field of vision passes through the transparent face shield and wherein the face shield also blocks wind and debris from the user's face, the apparatus comprising:

a polarized lens mounted to partially cover the transparent face shield, wherein a top portion of the transparent face shield is covered by the polarized lens to reduce glare in the user's field of vision when the user is holding their head comfortably in a normal upright position, and a lower portion of the transparent face shield is not covered by the polarized lens so that the user's primary field of vision is able to pass through the uncovered lower portion of the transparent face shield when the user's head is tilted back slightly; wherein:

the polarized lens is removably mounted to the helmet adjacent an outside surface of the transparent face shield; and the polarized lens further comprises a snow dust guard extending perpendicularly from an inside surface of the polarized lens along a bottom edge of the polarized lens to provide a seal between the polarized lens and the transparent face shield.

6. An apparatus for a helmet having a transparent face shield, wherein the transparent face shield is capable of being located in front of a user's face when the user is wearing the helmet so that the user's field of vision passes through the transparent face shield and wherein the face shield also blocks wind and debris from the user's face, the apparatus comprising:

a polarized lens mounted to partially cover the transparent face shield, wherein a top portion of the transparent face shield is covered by the polarized lens to reduce glare in the user's field of vision when the user is holding their head comfortably in a normal upright position, and a lower portion of the transparent face shield is not covered by the polarized lens so that the user's primary field of vision is able to pass through the uncovered lower portion of the transparent face shield when the user's head is tilted back slightly; wherein the polarized lens is removably mounted directly to the transparent face shield of the helmet by using:

a first piece of strip fastener applied along at least a portion of a top edge of the polarized lens and a mating piece of fastener applied along a top edge of the transparent face shield;

a second piece of strip fastener applied along at least a portion of a right side edge of the polarized lens and a mating piece of strip fastener applied along a right side edge of the transparent face shield; and a third piece of strip fastener applied along at least a portion of a left side edge of the polarized lens and a mating piece of strip fastener applied along a left side edge of the transparent face shield; and wherein the strip fastener on the polarized lens is mounted onto the strip fastener on the transparent face shield so that the polarized lens covers the transparent face shield from a top edge of the transparent face shield downward to a bottom edge of the polarized lens which is located above a bottom edge for the transparent face shield when the polarized lens is mounted to the helmet, the polarized lens spans continuously between the right side edge of the transparent face shield and the left side edge of the transparent face shield; and the polarized lens is tilted with respect to the transparent face shield and a bottom edge of the polarized lens rests at least partially against the transparent face shield.

7. The apparatus for a helmet having a transparent face shield as recited in claim 6 wherein the polarized lens covers approximately ⅔ of the surface area of the transparent face shield.

8. The apparatus for a helmet having a transparent face shield as recited in claim 6 wherein the polarized lens has a bottom edge that is located at least 1⅝ inch above a bottom edge of the transparent face shield when the polarized lens is mounted to the helmet.

9. A kit comprising:

a polarized lens shaped to partially cover a transparent face shield on a helmet when the lens is mounted on the helmet, wherein a top portion of the transparent face shield is covered by the polarized lens to reduce glare in the user's field of vision when the user holds their head in a normal upright position, and a lower portion of the transparent face shield is not covered by the polarized lens to allow the user's field of vision to pass through the uncovered lower portion when the user's head is tilted slightly back;

a first piece of strip fastener adhered to an inside surface of the polarized lens along a top edge of the polarized lens and a mating piece of strip fastener having an adhesive-backed surface covered by a backing strip which is adapted to be adhered along a top edge of the transparent face shield of the helmet;

a second piece of strip fastener adhered along at least a portion of a right side edge of the polarized lens on the inside surface of the polarized lens;

a third piece of strip fastener adhered to at least a portion of a left side edge of the polarized lens on the inside surface of the polarized lens;

a mating piece of strip fastener for the second piece of strip fastener on the right side edge of the polarized lens; and a mating piece of strip fastener for the third piece of strip fastener on the left side edge of the polarized lens, the mating pieces for both the second and third pieces each having an adhesive-backed surface covered by a backing strip;

wherein the mating pieces are adhered to the transparent face shield for the helmet by the user and the polarized lens is then removably mounted thereto with the polarized lens tilted with respect to the transparent face shield so that a bottom edge of the polarized lens rests at least partially against the transparent face shield.

10. A kit as recited in claim 9 further comprising a grip strip adhered to an outside surface of the polarized lens along a top edge of the polarized lens, the grip strip being made of an ultraviolet protected vinyl adhesive strip.

11. A kit as recited in claim 9 further comprising a bag for storing the polarized lens, the bag having an inside surface and an outside surface each made of an absorbent, scratch-resistant material.

12. An apparatus for a helmet having a transparent face shield, wherein the transparent face shield is capable of being located in front of a user's face when the user is wearing the helmet so that the user's field of vision passes through the transparent face shield and the face shield also blocks wind and debris from the user's face, the apparatus comprising:

a polarized lens that is removably mounted to the helmet adjacent an outside surface of the transparent face shield using narrow strips of adhesive-backed hook and loop fastener, at least one strip of hook and loop fastener being adhered to an inside surface of the polarized lens exclusively along a peripheral edge of the polarized lens, at least one mating strip of hook and loop fastener adhered to the helmet to engage the at least one strip of hook and loop fastener on the inside surface of the polarized lens, the strips of hook and loop fastener being applied to the polarized lens and the helmet in a manner which removably secures the polarized lens to the helmet and does not significantly obstruct the user's normal field of vision through the transparent face shield wherein a grip strip of an ultraviolet protected vinyl adhesive tape is adhered along an outer surface of the polarized lens along a top edge of the polarized lens.

13. The apparatus for a helmet having a transparent face shield as recited in claim 12 wherein the polarized lens extends outward beyond a removable strip of hook and loop fastener on either the left side or the right side of the polarized lens to provide handle means for facilitating the attachment or removal of the removable polarized lens from the helmet.

14. The apparatus for a- helmet having a transparent face shield as recited in claim 12 wherein the polarized lens is manufactured by forming the lens from a sheet of laminated linear polarizer in which the polarization axis of the laminated linear polarizer is generally horizontal when the lens is attached to the helmet.

* * * * *

UNITED STATES PATENT AND TRADEMARK OFFICE

CERTIFICATE OF CORRECTION

PATENT NO. : 5,975,823
DATED : November 2, 1999
INVENTOR(S) : Schlough

It is certified that error appears in the above-identified patent and that said Letters Patent is hereby corrected as shown below:

Title page,
The title page should be deleted to appear as per attached title page.
Please delete columns 1-10 and substitute columns 1-8 as per attached.

Signed and Sealed this

Seventeenth Day of December, 2002

JAMES E. ROGAN
*Director of the United States Patent and Trademark Office*

United States Patent [19]

Schlough

[11] Patent Number: 5,975,823

[45] Date of Patent: Nov. 2, 1999

[54] METHOD OF FORMING SHEET MATERIAL ASSEMBLAGE

[75] Inventor: James R. Schlough, Troy, Ohio

[73] Assignee: Heidelberger, Druckmaschinen AG, Heidelberg, Germany

[21] Appl. No.: 08/927,954

[22] Filed: Sep. 11, 1997

[51] Int. Cl.[6] ..... B65H 5/30

[52] U.S. Cl. ..... 412/8; 412/9; 412/19; 270/58.07; 270/58.08

[58] Field of Search ..... 412/4, 5, 8, 19, 412/9, 11; 270/52.14, 52.18, 58.01, 58.08, 52.23, 58.07

[56] References Cited

U.S. PATENT DOCUMENTS

| | | | |
|---|---|---|---|
| 2,895,730 | 7/1959 | Biel et al. | 270/37 |
| 4,170,346 | 10/1979 | Murray et al. . | |
| 4,420,148 | 12/1983 | Meadows | 270/41 |
| 4,477,067 | 10/1984 | Wise . | |
| 4,486,011 | 12/1984 | Rhunke | 270/52.23 |
| 4,641,825 | 2/1987 | Mowry et al. . | |
| 4,988,086 | 1/1991 | Schlough . | |
| 5,067,699 | 11/1991 | Gadway et al. . | |
| 5,232,324 | 8/1993 | Graushar . | |
| 5,261,769 | 11/1993 | Leclerc . | |
| 5,615,871 | 4/1997 | Kleinhen . | |
| 5,622,268 | 4/1997 | Conner et al. . | |
| 5,738,346 | 4/1998 | Ishida | 270/58.07 |

FOREIGN PATENT DOCUMENTS

| | | |
|---|---|---|
| 4334225 | 4/1995 | Germany . |

*Primary Examiner*—Andrea L. Pitts
*Assistant Examiner*—Henry W. H. Tsai
*Attorney, Agent, or Firm*—Tarolli, Sundheim, Covell, Tummino & Szabo

[57] ABSTRACT

A stack of signatures is formed with a folded cover at one end of the stack of signatures. At this time, the folded cover is inside out. Thus, outer side surfaces of front and rear leaves of the cover are disposed in engagement with each other and the inner surface on one of the leaves of the cover faces away from the stack of signatures. The cover is then unfolded and the inner side of the one leaf of the cover is moved into engagement with the opposite end of the stack of signatures. The stack of signatures is formed by moving signatures in a direction transverse to folded edges of the signatures and adding additional signatures to the moving signatures. The inside out folded cover is disposed at one end of the stack of signatures. The stack of signatures and cover are then moved in a direction parallel to folded edges of the signatures while the cover is inside out. As the cover is moved in a direction parallel to the folded edges of the cover, the cover is unfolded and refolded.

14 Claims, 3 Drawing Sheets

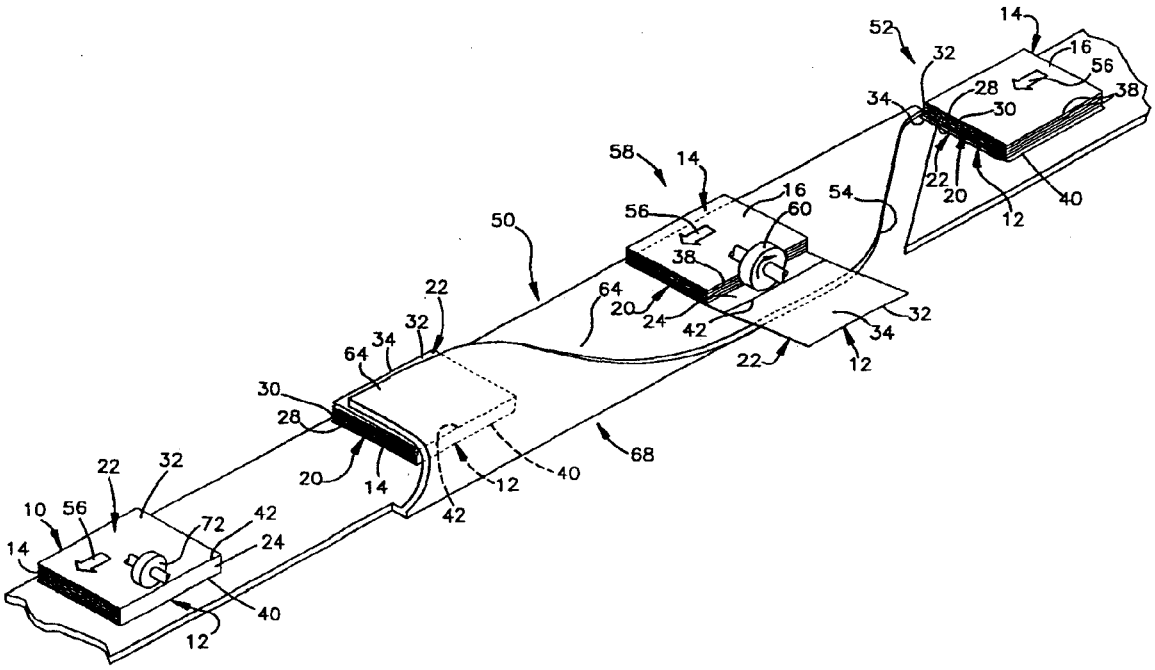

METHOD OF FORMING SHEET MATERIAL ASSEMBLAGE

BACKGROUND OF THE INVENTION

The present invention relates to a method of forming a sheet material assemblage, such as a book or magazine, having a cover which encloses a plurality of signatures.

A typical adhesive bound book, magazine or other sheet material assemblage may have its cover applied in a flat unfolded condition. The flat unfolded cover is applied while the cover and a group of signatures are being transported in a direction parallel to folded edge portions of the signatures. While the signatures and cover are matched in speed and position, the cover is pressed against the backbone of the book and adhesion occurs. The cover is then folded and creased around the backbone of the book. A known apparatus for forming a book in this manner is disclosed in U.S. Pat. No. 5,261,769.

In an effort to improve the process of forming a typical adhesive bound book, it has been proposed to transport the signatures in a direction perpendicular to the folded edge portions of the signatures. With this mode of transport, the distance from one book to the next book is not dependent upon the length of the folded edge portions of the signatures. However, this orientation of the signatures severely restricts the process of applying a cover, as the unfolded cover could overlap several books.

To avoid having the unfolded cover extend beneath several books, it has been proposed that the folded edge portions of the signatures be offset. The resulting array of folded signature edge portions is skewed at an acute angle to side surfaces of the signatures. With this proposal, the adhesive is applied and then the cover pressed against the folded edge portions of the signatures. However, it is believed that difficulty may be encountered with this proposed process.

SUMMARY OF THE INVENTION

The present invention provides an improved method of forming a book, magazine or other sheet material assemblage. With this method, a cover is folded inside out and is disposed at one end of a stack of signatures. An inner side surface on a first leave of the inside out cover engages one of the signatures in the stack of signatures. Outer side surfaces on the leaves of the cover face toward each other. The inner side surface on the second leaf of the cover faces away from the stack of signatures.

Adhesive may be applied to folded edges of the signatures and/or the cover. The second leave of the cover is then moved away from the first leave of the cover and into engagement with the stack of signatures. The second leave engages an end of the stack of signatures opposite from the end engaged by the first leave of the cover.

The stack of folded signatures may be formed by moving signatures in a direction transverse to folded edges of the signatures and adding additional signatures to the moving signatures. The folded cover is located at one end of the stack with the cover inside out. The stack of folded signatures and the inside out cover are then moved in a direction parallel to the folded edges of the signatures. As this is occurring, one of the leaves of the cover is moved across the folded edges of the signatures to an end of the stack of signatures opposite to the end engaged by the other leave of the cover.

BRIEF DESCRIPTION OF THE DRAWINGS

Figure 5:
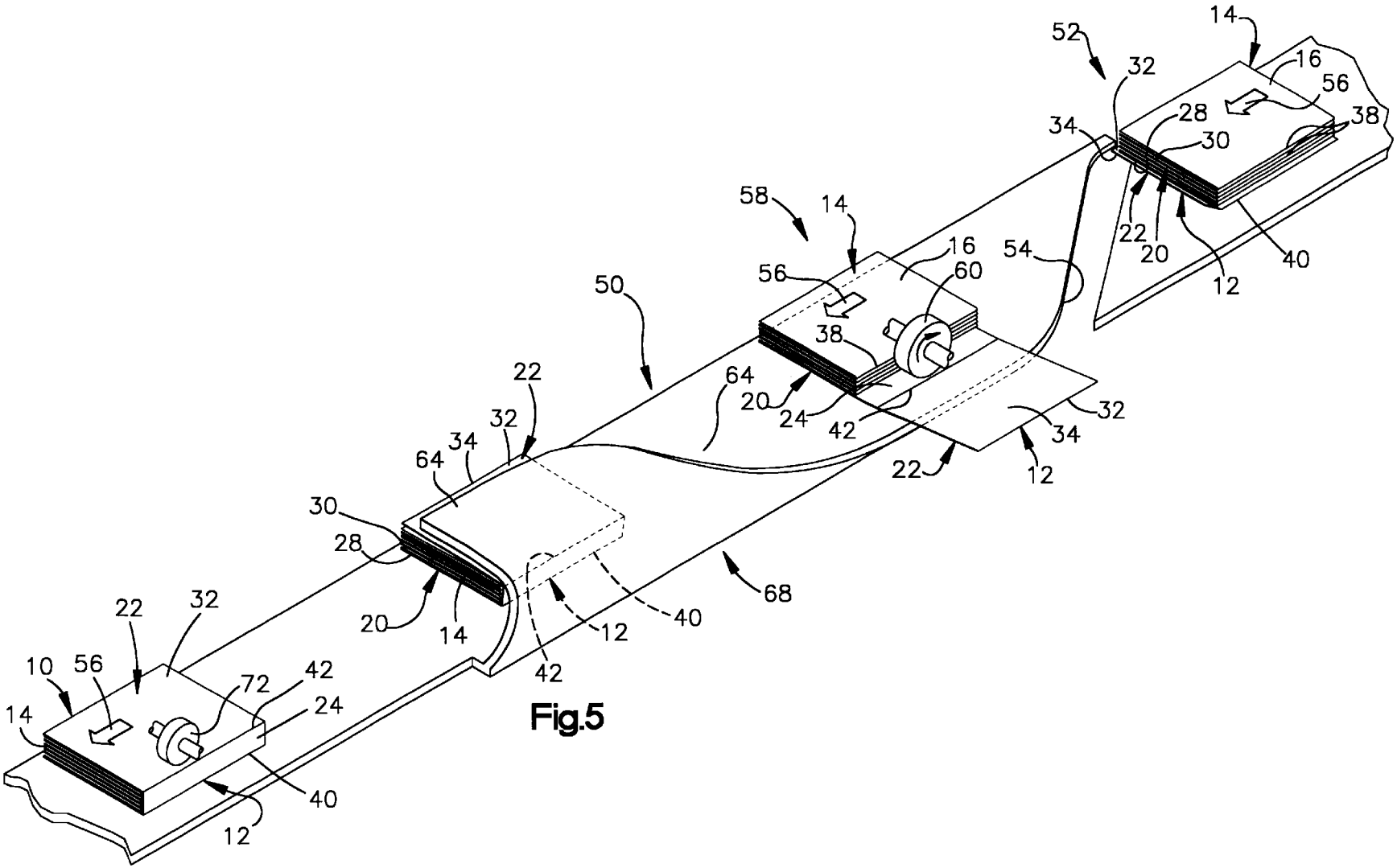
FIG. 5 is a top elevational view of a removable polarized lens shown in partial section to be attached to a transparent face shield on a helmet.
Figure 6:
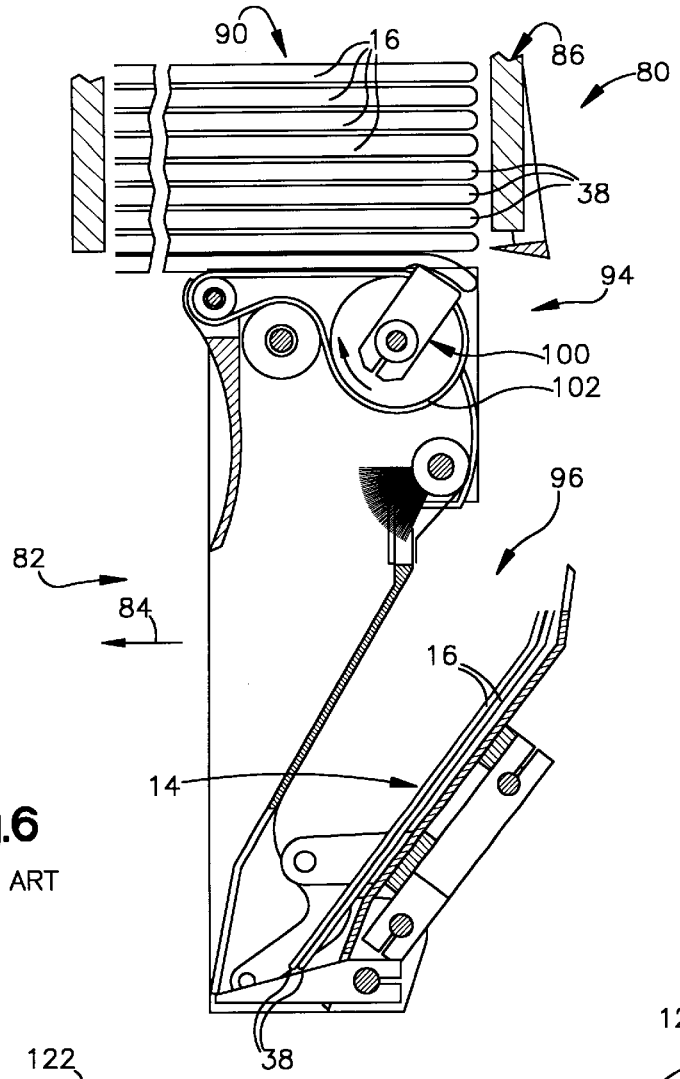
Fig.6 PRIOR ART
FIG. 6 is a sectional view similar to FIG. 4 showing another embodiment of the invention in which the polarized lens is adhered directly to an inside surface of the transparent face shield for the helmet.

The foregoing and other features of the invention will become more apparent upon a consideration of the following description taken in connection with the accompanying drawings wherein:

FIG. 1 is a fragmentary schematic illustration of a book or sheet material assemblage constructed with the method of the present invention;

FIG. 2 is a schematic illustration depicting the manner in which an inside out cover is positioned relative to one end of a stack of signatures;

FIG. 3 is a schematic illustration depicting the relationship of the inside out cover and the stack of signatures;

FIG. 4 is a view taken generally along the line 4—4 of FIG. 3, further illustrating the relationship of the inside out cover and the stack of signatures;

FIG. 5 is a schematic illustration depicting the manner in which the inside out cover is unfolded, and then folded over the stack of signatures while the stack of signatures is moving in a direction parallel to folded edges of the signatures;

FIG. 6 is a sectional view of a portion of one known apparatus which may be utilized to form the stack of signatures and inside out cover illustrated in FIGS. 3 and 4; and FIG. 7 is a schematic illustration of an alternative known apparatus which may be utilized to form the stack of signatures and inside out cover of FIGS. 3 and 4.

DESCRIPTION OF ONE SPECIFIC PREFERRED EMBODIMENT OF THE INVENTION

A typical adhesive bound book, magazine or similar sheet material assemblage 10 (FIG. 1) has a cover 12 which encloses a stack or assembly 14 of folded signatures 16. The cover 12 has a front leave 20 and a rear leave 22 which are interconnected by a spine or connector section 24 of the cover. The front leave 20 has an exposed outer side surface 28 and an inner side surface 30. The inner side surface 30 of the cover 12 is pressed against a front end of the stack or assembly 14 of signatures 16.

Similarly, the rear leave 22 has an exposed outer side surface 32 and an inner side surface 34. The inner side surface 34 of the cover 12 is pressed against a rear end of the stack or assembly 14 of signatures 16. The signatures 16 have folded edges 38 which are interconnected by adhesive and engage the spine 24 of the cover 12. Front and rear folds 40 and 42 interconnect the spine 24 and front and rear leaves 20 and 22 of the cover 12.

Although the illustrated book 10 has a flat spine 24 which interconnects the front and rear leaves 20 and 22 of the cover 12, it is contemplated that the spine 24 could have a generally U-shaped configuration or even a V-shaped configuration if desired. The illustrated cover 12 is formed of sheet material which is heavier than the sheet material forming the signatures 16. However, it is contemplated that the signatures 16 could be formed of material having the same weight as the cover 12.

When the book 10 is to be formed, the stack 14 of signatures is formed in the manner illustrated schematically in FIG. 2. The folded edges 38 of the signatures 16 are aligned with each other. A front signature **16*a* and a rear signature 16*b* in the stack 14 of signatures are exposed. The cover 12** is moved toward the stack of signatures in the manner indicated schematically in FIG. 2.

At this time, the cover is folded inside out along the front fold line 40. Therefore, the outer side surface 28 on the front leave 20 faces toward and engages the outer side surface 32 on the rear leave 22. The inner side surfaces 30 and 34 on the front and rear leaves are exposed and face away from each other. Since the cover 12 is folded along the front fold line 40, the upper edge of the rear leave 22 of the cover will extend upwardly (as viewed in FIG. 2) of the edge of the front leave 20. At this time, the cover 12 has not been folded along the rear fold line 42 and the spine 24 of the cover combines with the width of the rear leave 22 to exceed the width of the front leave 20.

The inside out folded cover 20 is moved downward (as viewed in FIG. 2) along a path extending perpendicular to the front fold line 40, into alignment with the stack 14 of signatures (FIGS. 3 and 4). The inside out folded cover 12 is positioned in alignment with the stack 14 of signatures in the manner illustrated in FIGS. 3 and 4. The folded edges 38 of the signatures 16 are illustrated as being skewed or offset slightly relative to each other to facilitate the application of adhesive to the signatures. However, if desired, adhesive could be applied to the signatures 16 with the folded edges 38 of the signatures aligned with each other.

The inside out cover 12 is illustrated in FIGS. 2–4 as being positioned on the front signature 16*a* of the stack 14 of signatures. However, the inside out cover 12 could be placed on the rear signature 16*b* of the stack 14 of signatures. If this was done, the inside but cover 12 would be folded along the rear fold line 42 and the inner side surface 34 of the rear leave 22 of the cover would be positioned in engagement with the rear signature 16*b* of the stack 14 of signatures.

A plow-type unfolder-folder 50 (FIG. 5) is utilized to first unfold the inside out folded cover 12 and then to fold the cover right side out over the stack 14 of signatures 16. The plow-type unfolder-folder has an unfolder section 52 with a blade 54 which enters between the front and rear leaves 20 and 22 of the cover 12. The blade 54 unfolds the cover 12 as the stack 14 and cover move in the direction of arrows 56 in FIG. 5.

The stack 14 of signatures and inside out cover 12 are moved along the unfolder section 52 in a direction parallel to the folded edges 38 of the signatures 16 and the front fold line 40 of the cover 12. As this occurs, the blade 54 pivots the rear leave 22 of the cover through 180° about the front fold line 40. This results in the cover 12 being moved from an inside out folded condition to the unfolded or flat condition illustrated in FIG. 5.

As the stack 14 of signatures 16 and the unfolded cover 12 continue to move in the direction of the arrows 56 in FIG. 5, adhesive is applied to the cover an/or the folded edges 38 of the signatures 16 at an adhesive application section 58. Thus, as the flat unfolded cover 12 and stack 14 of signatures 16 continues to move in a direction parallel to the folds 38 in the signatures, adhesive is applied to both an inner side surface of the spine 24 and the folded edges 38 of the signatures 16 by an adhesive applicator wheel 60. Since the folded edges 38 of the signatures 16 are offset, in the manner illustrated schematically in FIG. 4, the application of adhesive to the folded edges of the signatures by the wheel 60 is facilitated.

As the stack 14 of signatures 16 and cover 12 continue to move in the direction of the arrows 56, that is in a direction parallel to the folded edges 38 of the signatures 16, a folding plate 64 at a folder section 68 of the plow-type folder-unfolder 50 engages the rear leave 22 of the cover. The folding plate 64 moves the rear leave 22 of the cover 12 across the folded edges 38 of the signatures 16. The rear leave 22 moves into engagement with an upper (as viewed in FIG. 5) side of the stack 14 of signatures. As this occurs, the inner side surface 34 of the rear leave 22 is moved into engagement with the rear signature 16*b* (FIG. 2) in the stack 14 of signatures. The cover 12 is folded along the rear fold line 42. This results in the cover 12 being correctly folded with the outer side surface 32 of the rear leaf 22 exposed.

During continued movement of the stack 14 of signatures and correctly folded cover 12 in the direction of the arrow 56 in FIG. 5, that is, parallel to the folds 38 in the signatures 16, a presser wheel 72 applies force against the edge of the book 10. This force seals the cover 12 against the signatures 16. The signatures 16 are interconnected with each other and with the cover 12 by adhesive.

It is contemplated that the stack 14 of signatures and cover 12 could be assembled in many different ways with many different collating mechanisms. It is believed that a known collating mechanism 80 (FIG. 6) may be preferred. The signature 16 may comprise a plurality of folded sheets which are nested together so that some of the folded sheets are inside other folded sheets. Before the signatures 16 reach the collating mechanism 80, narrow strips of adhesive are applied to any inner sheets of the signatures. Pressure is applied against the outer sheets of the signatures 16 to interconnect the inner and outer sheets of the signatures with this adhesive.

The collating mechanism 80 includes a plurality of sheet material assemblers 82. The sheet material assemblers 82 are linked together and are moved in the direction indicated schematically by an arrow 84 in FIG. 6, along a continuous path under stationary bottomless hoppers 86. As the sheet material assemblers 82 move beneath each of stationary stacks 90 of signatures 16 in turn, the assemblers feed the signatures from the stacks with the folded edge portions 38 of the signatures leading.

Each sheet material assembler 82 includes a feed mechanism 94 and a receiving location 96. The feed mechanism 94 includes vacuum grippers or suckers 100 which grip a lowermost signature 16 in the stack 90 of signatures. The vacuum grippers 100 initiate downward movement of a gripped signature along a path extending between belts 102 to the pocket or receiving location 96. The feed mechanism 94 is operable to feed sheet material from each of the stacks 90 in turn to a single receiving location or pocket 96.

As the sheet material assembler 82 is moved past a plurality of stationary hoppers 86, the signatures 16 are sequentially fed into the receiving location 96 from each of the hoppers in turn. The assembler 82 moves in a direction perpendicular to the folded edges 38 of the signatures 16 in the receiving location 96. As the receiving location 96 moves beneath each of the stationary hoppers 86 in turn, a signature is fed downward from the hopper into the receiving location. This results in the formation of the stack 14 of signatures. The last signature fed from a stationary hopper 86 is the front signature 16*a* (FIG. 2) which completes the formation of the stack 14 of signatures.

The sheet material assembler 82 then moves in the direction 84 past a stationary hopper (not shown) containing inside out covers 12. A cover 12, which is folded inside out, is then fed downward from the hopper into the receiving location by the feed mechanism 94. The inside out cover 12 is fed to the receiving location 96 with the front fold 40 leading.

Once a complete stack of signatures 14 has been formed at the receiving location 96 and a cover 12 positioned on the stack, the sheet material assembler is moved, in a direction perpendicular to the folded edge portions 38 of the signatures 16, to a delivery location. At the delivery location, the bottom of the receiving location or pocket 96 is opened. The stack 14 of signatures 16 and the inside out cover 12 move onto a receiving conveyor (not shown). The receiving conveyor moves the stack 14 of signatures 16 and unfolded cover 12 to the unfolder-folder 50 with the stack of signatures and unfolded cover in the orientation illustrated in FIG. 5.

The construction and mode of operation of the collating mechanism 80 is the same as is disclosed in U.S. Pat. No. 4,988,086, issued Jan. 29, 1991 and entitled "Apparatus And Method For Forming Sheet Material Assemblages." Although it is believed that it may be preferred to use an apparatus having the construction and mode of operation disclosed in the aforementioned U.S. Pat. No. 4,988,086, to form the stack 14 of signatures and add the cover 12 to the stack, the apparatus could be constructed and operated in a manner similar to that disclosed in U.S. Pat. No. 4,721,296 issued Jan. 26, 1988, and entitled "Sheet Material Handling Apparatus."

The foregoing description of the operation of the collating mechanism 80 has assumed that the stack 14 of signatures is formed first and then the inside out cover 12 is added to the stack. However, the inside out cover 12 could be fed into the receiving location 96 before the signatures 16. This would result in the stack 14 of signatures 16 being assembled adjacent to the cover 12 as the cover is moved past each of the hoppers 86 in turn.

The delivery conveyor orients the stack 14 of signatures 16 and cover 12 so that they move in a direction parallel to the folded edge portions 38 of the signatures 16 with the cover disposed beneath the stack 12. The stack 14 of signatures and cover 12 are then moved into the unfolder section 52 of the plow-type unfolder-folder 50 (FIG. 5). As was previously explained, the unfolder-folder 50 unfolds the inside out cover 12 and refolds the cover around the stack 14 of signatures 16.

Although it is believed that it may be preferred to utilize the collating assembly 80 with bottom opening pockets 96 to receive the signatures 16 and cover 12, it is contemplated that other known types of collating mechanisms could be utilized if desired. The use of a known flat bed collating mechanism 120 to form the stacks 14 of signatures in association with inside out covers 12 is illustrated schematically in FIG. 7.

The collating mechanism 120 includes a series of stationary hoppers 122. A linear conveyor 124 extends beneath the series of hoppers 122. Although only two hoppers 122 have been illustrated schematically in FIG. 7, it should be understood that the linear series of hoppers include hoppers for each of the signatures 16 in the stack 14 of signatures and a hopper for inside out covers 12.

Known feed mechanisms 130 have been illustrated schematically in association with each of the hoppers 122. The feed mechanism 130 sequentially feed the inside out covers 12 and folded signatures 16 to receiving locations 132. The receiving locations 132 are disposed between pusher elements 134 connected with a conveyor chain 136.

As the receiving locations 132 move past a first one of the hoppers 122, inside out covers 12 are fed to the receiving locations. As the receiving locations 136 move past each of the hoppers 122 downstream from the first hopper, a different folded signature 16 is fed from each of the hoppers 122 in turn with the folded edge 38 of the signature leading. When a stack 14 (FIG. 2) of signatures has been formed at a receiving location 132, the stack of signatures is disposed on top of an inside out cover 12.

During the formation of the stack 14 of signatures and the positioning of the inside out cover 12, the stack of signatures moves in a direction perpendicular to the folded edges 38 of the signatures, in the manner indicated schematically by an arrow 140 in FIG. 7. The completed stack 14 of signatures is then fed onto a delivery conveyor. The delivery conveyor changes the orientation of the stack so that the cover 12 and stack 14 of signatures are moved in a direction parallel to the folded edges 38 of the signatures 16 and cover fold line 42. The stack 14 of signatures and the cover are then moved into the plow-type unfolder-folder 50 (FIG. 5).

In view of the foregoing description, it is apparent that the present invention provides a new and improved method of forming a book, magazine or other sheet material assemblage 10. With this method, a cover 12 is folded inside out and is disposed at one end of a stack 14 of signatures 16. An inner side surface 30 on a first leave 20 of the inside out cover 12 engages one of the signatures 16 in the stack 14 of signatures. Outer side surfaces 28 and 32 on the leaves 20 and 22 of the cover 12 face toward each other. The inner side 34 of the second leaf 22 of the cover 12 faces away from the stack 14 of signatures.

Adhesive may be applied to the folded edges 38 of the signatures 16 and/or the cover 12. The second leave 22 of the cover 12 is then moved away from the first leave 20 of the cover and into engagement with the stack 14 of signatures. The second leave 22 engages an end of the stack 14 of signatures 16 opposite from the end engaged by the first leave 20 of the cover 12.

The stack 14 of folded signatures 16 is formed by moving signatures in a direction transverse to folded edges 38 of the signatures and adding additional signatures to the moving signatures. The folded cover 12 is positioned at one end of the stack 14 with the cover inside out. The stack 14 of folded signatures 16 and the inside out cover 12 are then moved in a direction parallel to the folded edges 38 of the signatures 16. As this is occurring, the leave 22 of the cover 12 is moved across the folded edges 38 of the signatures 16 to an end of the stack 14 of signatures opposite to the end engaged by the other leave 20 of the cover.

From the above description of the invention, those skilled in the art will perceive improvements, changes and modifications. Such improvements, changes and modifications within the skill of the art are intended to be covered by the appended claims.

Having described the invention, the following is claimed:

1. A method of forming a sheet material assemblage with a cover, said method comprising the steps of:

forming a stack of signatures with the cover at one end of the stack with an inner side surface on a first leave of the cover in engagement with one of the signatures in the stack of signatures, with outer side surfaces on first and second leaves of the cover facing toward each other, and with an inner side surface on the second leave of the cover facing away from the stack of signatures; and moving the second leave of the cover away from the first leave of the cover and into engagement with a signature at an end of the stack opposite to the one end while the inner side surface on the first leave of the cover remains in engagement with the signature at the one end of the stack of signatures.

2. A method as set forth in claim 1 further including the step of applying adhesive to the stack of signatures prior to moving the second leave of the cover into engagement with the signature in the stack of signatures opposite to the one signature and while the inner side surface on the first leave of the cover remains in engagement with the one signature in the stack of signatures.

3. A method as set forth in claim 1 wherein said step of forming a stack of signatures with a cover at one end of the stack includes moving signatures forming a portion of the stack of signatures in a direction transverse to folded edges of the signatures and adding signatures to the stack of signatures, and, thereafter, moving the stack of signatures and the cover in a direction parallel to folded edges of the signatures forming the stack of signatures, said step of moving the second leave of the cover away from the first leave of the cover being performed while moving the stack of signatures in the direction parallel to the folded edges of the signatures.

4. A method as set forth in claim 3 further including the step of applying adhesive to at least one of the cover and the stack of signatures while the stack of signatures and cover are moving in the direction parallel to the folded edges of the signatures.

5. A method as set forth in claim 1 wherein said step of moving the second leave of the cover away from the first leave of the cover and into engagement with a signature at an end of the stack of signatures opposite to the one end includes pivoting the second leave of the cover relative to the first leave of the cover about a connection between the first and second leaves of the cover.

6. A method as set forth in claim 1 wherein said step of moving the second leave of the cover away from the first leave of the cover and into engagement with a signature at the end of the stack of signatures opposite to the one end includes moving the second leave of the cover from a position in which the first and second leaves of the cover are disposed adjacent to one side of the stack of signatures to a position in which the first leave of the cover is adjacent to the one side of the stack of signatures and the second leave of the cover is disposed adjacent to a side of the stack of signatures opposite to the one side of the stack of signatures and a portion of the cover extends across folded edge portions of signatures in the stack of signatures.

7. A method as set forth in claim 1 wherein said step of forming a stack of signatures with a cover at one end of the stack includes positioning the cover and stack of signatures with the cover offset to one side of the stack of signatures and with folded edge portions of the signatures exposed, said step of moving the second leave of the cover away from the first leave of the cover and into engagement with a signature at an end of the stack opposite to the one end includes moving a portion of the cover across folded edge portions of the signatures to enclose the folded edge portions of the signatures in the stack of signatures.

8. A method of forming a sheet material assemblage with a cover, said method comprising the steps of:

forming an assembly of folded signatures by moving signatures in a direction transverse to folded edges of the signatures and adding additional signatures to the moving signatures;

providing one end of the assembly of folded signatures with a folded cover which is inside out and has two leaves;

thereafter, moving the assembly of folded signatures and the cover in a direction parallel to folded edges of the signatures while the cover is inside out; and moving one of the leaves of the cover across the folded edges of the signatures to an end of the assembly of signatures opposite to the one end while moving the assembly of signatures and cover in the direction parallel to the folded edges of the signatures.

9. A method as set forth in claim 8 further including the step of applying adhesive to at least one of the cover and folded edges of the signatures while moving the assembly of signatures and cover in the direction parallel to the folded edges of the signatures.

10. A method as set forth in claim 8 wherein said step of moving the assembly of folded signatures and the cover in a direction parallel to folded edges of the signatures and the cover while the cover is inside out is performed with an inner side surface of a first leave of the cover in engagement with a signature at the one end of the assembly of signatures, outer side surfaces on the two leaves of the cover in engagement, and an inner side surface of a second leave of the cover facing away from the assembly of signatures.

11. A method as set forth in claim 10 wherein said step of moving one of the leaves of the cover across the folded edges of the signatures includes moving the inner side surface of the second leave of the cover into engagement with a signature at an end of the assembly of signatures opposite to the one end of the assembly of signatures.

12. A method as set forth in claim 8 wherein said step of moving one of the leaves of the cover across the folded edges of the signatures includes pivoting the one leave of the cover about an interconnection between the leaves of the cover.

13. A method as set forth in claim 8 wherein said step of moving one of the leaves of the cover across the folded edges of the signatures includes moving a portion of the cover into engagement with the folded edges of the signatures.

14. A method as set forth in claim 8 wherein said step of moving one of the leaves of the cover across the folded edge of the signatures includes unfolding the cover and then refolding the cover.

* * * * *